US008613436B2

(12) United States Patent
Tas et al.

(10) Patent No.: US 8,613,436 B2
(45) Date of Patent: Dec. 24, 2013

(54) COVER FEEDING DEVICE

(75) Inventors: Yahya Tas, Stemwede (DE); Jürgen Garlichs, Rahden (DE); Andreas Walther, Bünde (DE)

(73) Assignee: Kolbus GmbH & Co. KG, Rahden (DE)

( * ) Notice: Subject to any disclaimer, the term of this patent is extended or adjusted under 35 U.S.C. 154(b) by 266 days.

(21) Appl. No.: 13/373,517

(22) Filed: Nov. 17, 2011

(65) Prior Publication Data

US 2012/0128447 A1 May 24, 2012

(30) Foreign Application Priority Data

Nov. 20, 2010 (DE) ..... 10 2010 052 111

(51) Int. Cl.
*B42C 7/00* (2006.01)

(52) U.S. Cl.
USPC ..... 270/52.2; 270/52.18; 270/52.17; 412/4; 271/171

(58) Field of Classification Search
USPC ..... 270/52.2, 52.18, 52.14, 52.16, 52.17, 270/52.19; 271/171; 412/4, 18, 19
See application file for complete search history.

(56) References Cited

U.S. PATENT DOCUMENTS 5,662,448 A * 9/1997 Graushar et al. ..... 412/4
5,868,539 A * 2/1999 Rathert ..... 412/5
6,267,366 B1 * 7/2001 Graushar et al. ..... 270/1.02
6,302,388 B1 * 10/2001 Graushar et al. ..... 270/1.02
6,364,590 B1 * 4/2002 Gayoso ..... 412/18
6,386,812 B2 * 5/2002 Garlichs et al. ..... 412/19
7,621,516 B2 * 11/2009 Feuiltault et al. ..... 270/52.16
7,819,615 B2 * 10/2010 Trovinger et al. ..... 412/1
8,083,455 B2 * 12/2011 Graushar et al. ..... 412/5
8,475,104 B2 * 7/2013 Mueller ..... 412/13
8,517,656 B2 * 8/2013 Hartshorne et al. ..... 412/11

FOREIGN PATENT DOCUMENTS

GB 633358 12/1949

OTHER PUBLICATIONS

European Search Report EP11 00 9131, dated Mar. 19, 2012.
Publication XP-002671706 by Dieter Liebau, Inés Heinze: "Industrielle Buchbinderei" pp. 305-309.

* cited by examiner

*Primary Examiner* — Patrick Mackey
(74) *Attorney, Agent, or Firm* — Alix, Yale & Ristas, LLP

(57) ABSTRACT

In a cover feeding device (1) for feeding covers (13, 13.1, 13.2, 13.3) separated from a magazine (3, 3') to book blocks (14.1, 14.2, 14.3) that are transported while being clamped in book block grippers (2), it is proposed that the magazine (3, 3') features at least a first lateral stop (6.1) that is arranged such that it can be fixed transverse to the withdrawal direction (12) and against which different covers (13, 13.1, 13.2, 13.3) intended, in particular, for book blocks (14.1, 14.2, 14.3) of different thickness can be jointly placed, and that at least the magazine (3, 3') can be adjusted transverse to the withdrawal direction (12) such that an edge (17) of the spine region of the respective cover to be separated is withdrawn essentially in alignment with the rigid gripping jaw (2 *a*).

20 Claims, 1 Drawing Sheet

COVER FEEDING DEVICE

BACKGROUND

The present invention pertains to a cover feeding device for feeding covers separated from a magazine to book blocks.

In the industrial production of brochures, book blocks are assembled by means of perfect binding and provided with a cover that is pressed on the glue-coated spine and, if applicable, laterally thereof. The covers are separated from a magazine, scored in the spine region and synchronously fed to the book blocks that are clamped in book block grippers revolving continuously along an oval track. A cover feeding device of this type in the form of a cover station for perfect binders is described in [Liebau, Dieter and Heinze, Inéz: Industrial Bookbinding, Beruf+Schule Publishing, 2001; p. 309].

Lateral stops in the cover magazine, as well as guide rails on the cover transport device, are adjusted to the respective cover format to be processed transverse to the cover conveying direction such that the cover is pressed on the spine of the book block in an accurately positioned fashion with its spine region that usually has a special shape. In this case, the lateral stops can only be adjusted on an empty magazine because the covers would otherwise be pushed over the magazine bottom such that visible friction markings can be produced or the covers may even crumple. Consequently, the covers for brochure formats to be subsequently produced can only be inserted into the magazine after the corresponding adjustments have been carried out, wherein this represents a very elaborate procedure, particularly for small editions, and results in long set-up times relative to the actual production time.

SUMMARY

The present objective is to provide a device for feeding covers separated from a magazine to book blocks, with which it is possible to adjust a magazine that is already filled with covers to a different brochure format in such a way that the product is handled gently.

The covers are placed against at least one lateral stop. During a format change, the entire magazine is simply adjusted transverse to the withdrawal and conveying direction of the covers such that an edge of the spine region of the respective cover to be separated is withdrawn essentially in alignment with the rigid gripping jaw and fed onward. A displacement of the at least one lateral stop is not required. The stack of covers remains at the originally placed position in the magazine during the transverse adjustment thereof such that particularly the bottom cover is not pushed over the magazine bottom. This allows the production of different brochures without the corresponding set-up times, wherein a motor-driven transverse adjustment of the entire magazine can be carried out in the cyclic intervals between successively separated covers.

The transverse adjustment of the magazine can also be used for aligning the covers to the block spine edges. As a result, the covers are transported from the magazine to the point, at which they are assembled with the book blocks, along a straight line that extends parallel to the conveying direction of the book blocks. Lateral aligning displacements that were carried out until now after the separation and could cause markings on covers with sensitive surfaces do not take place. The covers are transported in a particularly smooth fashion such that the stopping risk is significantly reduced.

The separation of the covers—with the aid of separating means such as suction cups, stack lifters and blast air, as well as a pull-off conveyor—can always take place at the same location on the cover if the separating device is adjusted transverse to the withdrawal and conveying direction together with the magazine.

A first conveying section of the transport device that extends up to the scoring device, features outer cover guide rails and feeds the withdrawn covers to the scoring device advantageously is transversely adjusted together with the magazine. The interface between the units of the cover feeding device that can be adjusted transverse to the withdrawal direction and the stationary units lies downstream of the scoring device, the first scoring tool pair of which is aligned with the rigid gripping jaw of the book block grippers.

In a preferred additional development, a second lateral stop is provided opposite of the first lateral stop and coupled to the drive of the first lateral stop such that the two lateral stops can be adjusted in accordance with the width of the cover symmetrically referred to the cover center. The covers lie against both lateral stops and therefore are reliably guided. This makes it possible to process covers that are intended for book blocks of different sizes or at least book blocks of varying thickness and printed on sheets of the same size as they are typically used in the digital color printing of small editions. In this case, the magazine is respectively adjusted transverse to the withdrawal direction by half the block thickness change referred to the preceding brochure.

The covers can be effectively aligned on the at least one lateral stop with a jogging device integrated into the magazine.

In a first embodiment, the feeding device consists of a transversely displaceable stream feeder for covers, on which the covers lie on top of one another in a forwardly overlapping formation. In a second embodiment, the feeding device consists of a transversely displaceable standing sheet feeder. The covers stand on their head or foot edge and are supported on a magazine wall. The magazine of the standing sheet feeder preferably is arranged above the cover transport device such that the covers stand on their separation edge and a stack of differently high covers can be inserted for continuous processing.

In another embodiment, the magazine features a sensor for identifying the covers such that the correct combination of cover and book block can be checked prior to the separation. The identification of the covers furthermore makes it possible to determine the respective values for the transverse adjustment of the magazine.

BRIEF DESCRIPTION OF THE DRAWING

Aspects of the invention are disclosed in greater detail with reference to the drawing in which.

DETAILED DESCRIPTION

Figure 1:
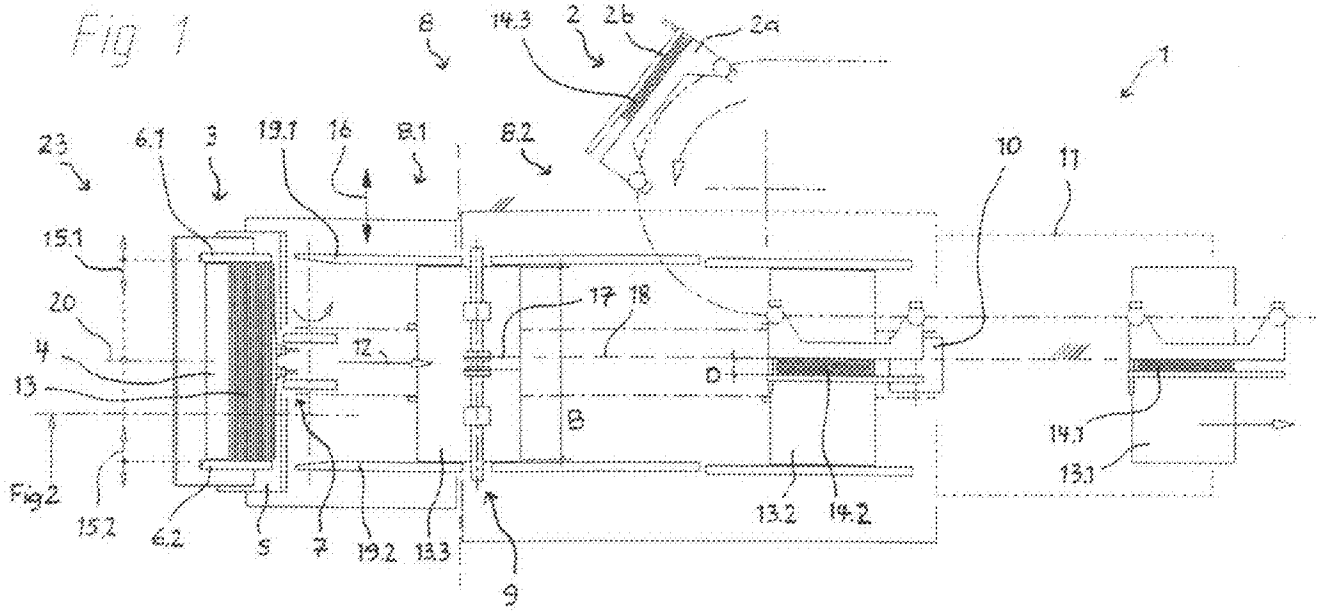
FIG. 1 shows a standing sheet feeder in the form of a top view.

FIG. 1 shows a section of a perfect binder with book block grippers 2 that continuously revolve along an oval track and in which book blocks 14.1, 14.2, 14.3 are clamped between a rigid inner gripping jaw 2 *a* and an outer gripping jaw 2 *b* that can be moved relative thereto. The book blocks 14.1, 14.2, 14.3 are initially processed on the spine and assembled with glue, wherein the book blocks are subsequently connected to a cover 13.1, 13.2, 13.3.

The covers 13 are synchronously fed to the book blocks 14.1, 14.2, 14.3 by a cover feeding device 1. This cover feeding device comprises a magazine 3, in which the covers 13 are situated, a separating device 7 for withdrawing the covers 13 from the magazine 3, a transport device 8 for synchronously feeding the separated covers 13.2, 13.3 to the book blocks 14.2, 14.3, a scoring device 9 for scoring the covers 13.3, a pressing roller 10, by means of which a supplied cover 13.2 is connected to the respective book block 14.2, and a cover press-on device 11 for pressing the cover 13.1 against the spine and, if applicable, lateral regions of the book block 14.1 near the spine.

Figure 2:
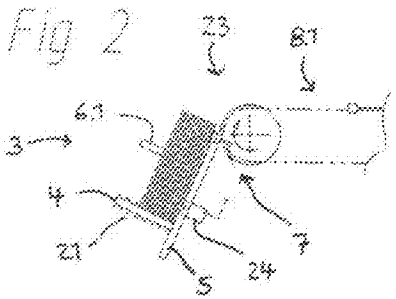
FIG. 2 shows the standing sheet feeder of FIG. 1 in the form of a sectional representation.

In the exemplary embodiment according to FIG. 1, the magazine 3 with the separating device 7 is realized in the form of a standing sheet feeder 23, in which the covers 13 stand on a bottom 4 with their head edge and are supported on a wall 5 (see FIG. 2). The respective bottom cover 13 is separated by means of suction cups in the region of its foot edge, withdrawn by means of a gripper drum and downstream pull-off rollers and transferred to the transport device 8, in which the separated covers 13.2, 13.3 are pushed to the pressing roller 10 by pushers of a chain conveyor.

The magazine 3 features a first lateral stop 6.1 that is arranged such that it can be fixed transverse to the withdrawal and conveying direction 12 and against which different covers 13.1, 13.2, 13.3 intended, in particular, for book blocks 14.1, 14.2, 14.3 of different thickness can be jointly placed. The position of the lateral stop 6.1 can be changed manually or in a motor-driven fashion. A second lateral stop 6.2 is arranged opposite of the first lateral stop and coupled to the drive thereof such that the two lateral stops 6.1, 6.2 can be fixed in accordance with the width B of the cover symmetrically referred to the cover center 20. In FIG. 1, the adjustment of the lateral stops 6.1, 6.2 that is defined as the basic adjustment of the cover width is symbolically illustrated in the form of interconnected double arrows 15.1, 15.2 that are drawn with broken lines. A jogging device 21 ensures that the covers 13 align on the lateral stops 6.1, 6.2 and the bottom 4.

According to the invention, the entire magazine 3 can be adjusted transverse to the withdrawal and conveying direction 12, wherein the separating device 7 and a first conveying section 8.1 of the transport device 8 are adjusted together with the magazine 3. The adjustment 16 of this unit is realized automatically in the form of a motor-driven actuation of corresponding adjusting axles, namely relative to the scoring device 9 and a stationary conveying section 8.2 of the transport device 8.

The adjustment 16 is carried out between successively separated covers 13, namely in such a way that an edge 17 of the spine region of the respective cover 13 that should be separated next and is intended for a book block of different block thickness D is withdrawn essentially in alignment with the rigid gripping jaw 2 *a*. A thusly separated cover 13.3 no longer needs to be laterally displaced and aligned, but rather is fed to the scoring device 9 essentially straight—while being guided between cover guide rails 19.1, 19.2. The corresponding spine edge 17 is illustrated in FIG. 1 in the form of the spine scoring 17 created by the scoring of the covers 13. This figure also shows the alignment 18 referred to the rigid inner gripping jaw 2 *a*.

In FIG. 1, book blocks 14.1, 14.2, 14.3 of different thickness are clamped in the three book block grippers 2 shown. In this case, the book blocks 14.1, 14.2, 14.3 may comprise the same number of pages, but have a different thickness due to paper thickness fluctuations, or the book blocks 14.1, 14.2, 14.3 comprise different numbers of pages and therefore have a different block thickness D. The respective block thickness D of the book blocks is preferably measured while they are fed to the book block grippers 2 and adjusted in the different processing stations of the perfect binder, past which the corresponding book block is transported by the book block gripper 2, in a precisely timed fashion such that the book blocks 14.1, 14.2, 14.3 are processed in accordance with their block thickness. The spacing between the scoring tools in the scoring device 9 is adjusted to the corresponding block thickness D, for example, in the region of the cover feed and the press-on device, wherein the scoring tool assigned to the rigid inner gripping jaw 2 *a* remains stationary. As described above, the magazine 3 is positioned in accordance with the respective block thickness D together with the separating device 7 and the first conveying section 8.1.

In the exemplary embodiment according to FIG. 1 with the lateral stops 6.1, 6.2 that can be jointly adjusted referred to the cover center 20, it is possible to process different covers 13 that are printed on sheets of the same size as they are typically used in the digital color printing of small editions and in which the print image is positioned on the sheet centrally. Since the book block grippers 2 feature a rigid inner gripping jaw 2 *a*, the covers 13 need to be respectively displaced relative to the preceding cover transverse to the withdrawal and conveying direction 12 by half the block thickness change in order to feed the covers to the book blocks in a precisely fitted fashion. According to the invention, this displacement is realized in the form of an automatic adjustment 16 of the aforementioned unit consisting of the magazine 3, the separating device 7 and the first conveying section 8.1. The stack of different covers 13 situated in the magazine 3 remains at the originally placed position during the transverse adjustment 16.

A sensor 24 arranged on the magazine 3 can identify the respective bottom cover 13 in the magazine. This makes it possible to check the correct combination of cover and book block prior to the separation. The identification may also serve for determining the position of the spine region in the covers if the print image is not uniformly arranged centrally on the sheet as described above, but rather randomly. To this end, an edge can be detected by the sensor or position information assigned to the identified cover is retrieved from a database.

Figure 3:
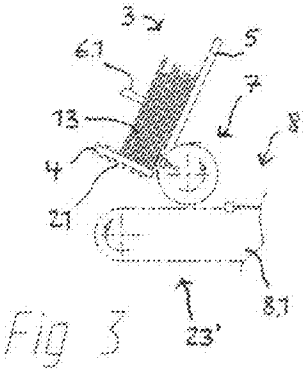
FIG. 3 shows a standing sheet feeder arranged above the cover transport plane in the form of a sectional representation.

FIG. 3 shows a standing sheet feeder 23', in which the magazine 3 is arranged above the transport device 8, namely in the form of the same sectional representation as in FIG. 2. The covers 13 stand on the bottom 4 with their foot edge and are downwardly withdrawn from the magazine 3 with the foot edge pointing forward. Such a magazine arrangement allows the uninterrupted processing of covers 13 of different height because a format adjustment of the bottom 4 in accordance with the cover height is, in contrast to the magazine arrangement according to FIG. 2, not required in this case.

Figure 4:
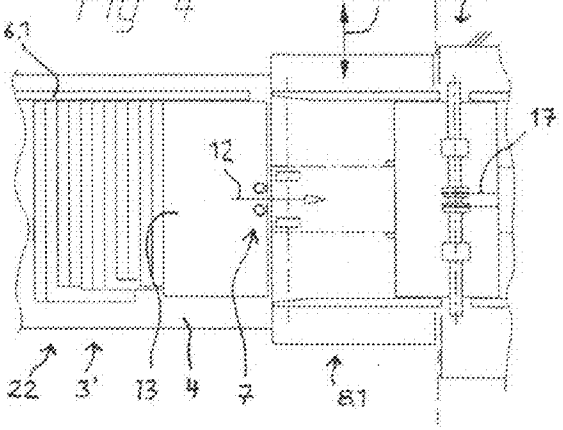
FIG. 4 shows a detail of a stream feeder in the form of a top view.

FIG. 4 shows an inventive stream feeder 22. The covers 13 are situated in the magazine 3' such that they lie on top of one another in a forwardly overlapping formation and jointly placed against a lateral stops 6.1 with an outer edge. The covers 13 may have a different width. The aforementioned unit consisting of the magazine 3', the separating device 7 and the first conveying section 8.1 is adjusted transverse to the withdrawal and conveying direction 12 in accordance with the position of the spine region of the respectively next cover 13 such that the respective covers 13 are fed to the scoring device along a straight line.

The invention claimed is:

1. A cover feeding device (1) for a bookbinding machine comprising book block grippers (2) that continuously revolve along a closed track and have a rigid inner gripping jaw (2 *a*) and an outer gripping jaw (2 *b*) that can be moved relative thereto and thereby clamp and move book blocks on a moving plane, a magazine (3, 3') having lateral stops (6.1, 6.2) and in which covers (13) are situated, a separating device (7) for withdrawing the covers (13) from the magazine (3, 3') along a withdrawal direction, a transport device (8) that is arranged underneath the moving plane of the book blocks (14.1, 14.2, 14.3) and feeds the separated covers (13.1, 13.2, 13.3), a scoring device (9) for scoring edges of a spine region of each withdrawn cover (13.3), a cover press-on device (11) for pressing the cover (13.1) against the spine of the book block (14.1), wherein the magazine (3, 3') includes at least a first lateral stop (6.1) that is arranged such that it can be fixed transverse to the withdrawal direction (12) and against which different covers (13, 13.1, 13.2, 13.3), for book blocks (14.1, 14.2, 14.3) of different thickness are jointly placed, and wherein at least the magazine (3, 3') is adjustable transverse to the withdrawal direction (12) such that an edge (17) of the spine region of the respective cover to be separated is withdrawn essentially in alignment with the rigid gripping jaw (2 *a*).

2. The cover feeding device according to claim 1, wherein the separating device (7) is adjustable transverse to the withdrawal direction (12) together with the magazine (3, 3').

3. The cover feeding device according to claim 1, wherein a first conveying section (8.1) of the transport device (8) extends up to the scoring device (9) and includes outer cover guide rails (19.1, 19.2), and said first conveying section is adjustable transverse to the withdrawal direction (12) together with the magazine (3, 3').

4. The cover feeding device according to claim 1, wherein the magazine (3, 3') includes a second lateral stop (6.2) that is arranged opposite to the first lateral stop (6.1) and coupled to the drive of the first lateral stop (6.1) in such a way that the two lateral stops (6.1, 6.2) can be fixed in accordance with the width (B) of the cover symmetrically referred to the cover center (20).

5. The cover feeding device according to claim 1, wherein the magazine (3) includes a jogging device (21).

6. The cover feeding device according to claim 1, wherein the magazine (3') and the separating device (7) form a stream feeder (22), on which the covers (13) lie on top of one another in a forwardly overlapping formation.

7. The cover feeding device according to claim 1, wherein the magazine (3) and the separating device (7) form a standing sheet feeder (23, 23').

8. The cover feeding device according to claim 7, wherein the magazine (3) is arranged above the transport device (8) of the covers (13).

9. The cover feeding device according to claim 1, wherein the magazine (3) includes a sensor (24) for identifying the covers (13).

10. The cover feeding device according to claim 2, wherein a first conveying section (8.1) of the transport device (8) extends up to the scoring device (9) and includes outer cover guide rails (19.1, 19.2), and said first conveying section is adjustable transverse to the withdrawal direction (12) together with the magazine (3, 3').

11. The cover feeding device according to claim 2 wherein the magazine (3, 3') includes a second lateral stop (6.2) that is arranged opposite to the first lateral stop (6.1) and coupled to the drive of the first lateral stop (6.1) in such a way that the two lateral stops (6.1, 6.2) can be fixed in accordance with the width (B) of the cover symmetrically referred to the cover center (20).

12. The cover feeding device according to claim 2, wherein the magazine (3) includes a jogging device (21).

13. The cover feeding device according to claim 2, wherein the magazine (3') and the separating device (7) form a stream feeder (22), on which the covers (13) lie on top of one another in a forwardly overlapping formation.

14. The cover feeding device according to claim 10, wherein the magazine (3, 3') includes a second lateral stop (6.2) that is arranged opposite to the first lateral stop (6.1) and coupled to the drive of the first lateral stop (6.1) in such a way that the two lateral stops (6.1, 6.2) can be fixed in accordance with the width (B) of the cover symmetrically referred to the cover center (20).

15. The cover feeding device according to claim 10, wherein the magazine (3) includes a jogging device (21).

16. The cover feeding device according to claim 10, wherein the magazine (3') and the separating device (7) form a stream feeder (22), on which the covers (13) lie on top of one another in a forwardly overlapping formation.

17. The cover feeding device according to claim 3, wherein the magazine (3, 3') includes a second lateral stop (6.2) that is arranged opposite to the first lateral stop (6.1) and coupled to the drive of the first lateral stop (6.1) in such a way that the two lateral stops (6.1, 6.2) can be fixed in accordance with the width (B) of the cover symmetrically referred to the cover center (20).

18. The cover feeding device according to claim 17, wherein the magazine (3) includes a jogging device (21).

19. The cover feeding device according to claim 14, wherein the magazine (3) includes a sensor (24) for identifying the covers (13).

20. The cover feeding device according to claim 17, wherein the magazine (3) includes a sensor (24) for identifying the covers (13).

* * * * *